US007621201B2

(12) United States Patent
Hanna

(10) Patent No.: US 7,621,201 B2
(45) Date of Patent: Nov. 24, 2009

(54) HOT FORMING TOOLS FOR ALUMINUM AND MAGNESIUM SHEETS

(75) Inventor: Michael D. Hanna, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 66 days.

(21) Appl. No.: 12/042,537

(22) Filed: Mar. 5, 2008

(65) Prior Publication Data

US 2009/0223275 A1 Sep. 10, 2009

(51) Int. Cl.
*C21D 1/06* (2006.01)
*C22C 38/00* (2006.01)
*B24C 1/00* (2006.01)

(52) U.S. Cl. ..... 76/107.1; 72/39; 72/53; 72/57; 72/60; 148/218; 148/219

(58) Field of Classification Search ..... 72/39, 72/41, 42, 43, 53, 57, 60; 148/217, 218, 148/219, 220; 451/39; 76/107.1
See application file for complete search history.

(56) References Cited

U.S. PATENT DOCUMENTS

| | | | | | |
|---|---|---|---|---|---|
| 4,596,611 | A * | 6/1986 | Dawes et al. | ..... | 148/217 |
| 5,095,734 | A * | 3/1992 | Asher | ..... | 72/467 |
| 5,252,146 | A * | 10/1993 | Wen et al. | ..... | 148/218 |
| 5,571,341 | A * | 11/1996 | Jackel | ..... | 148/218 |
| 5,598,730 | A * | 2/1997 | Dillon | ..... | 72/53 |
| 5,810,947 | A * | 9/1998 | Wu et al. | ..... | 148/218 |
| 5,887,475 | A * | 3/1999 | Muldner | ..... | 72/389.3 |
| 6,327,884 | B1 * | 12/2001 | Wills | ..... | 72/389.3 |

FOREIGN PATENT DOCUMENTS

WO WO 2006019983 2/2006

* cited by examiner

*Primary Examiner*—David B Jones
(74) *Attorney, Agent, or Firm*—Reising Ethington P.C.

(57) ABSTRACT

A ferrous metal tool is provided for the forming of light metal sheet workpieces at elevated temperatures, with the forming surface of the tool prepared to minimize friction and adhesion when engaged in deformation of the hot sheet metal. The forming surface of a steel tool is nitrocarburized to form a compound layer and diffusion layer on the surface. The compound layer initially comprises an outer gamma-phase material and an underlying epsilon phase material. Gamma-phase material is removed to expose underlying epsilon phase material, and low friction particles are embedded in the modified nitrocarburized compound layer of the forming tool.

14 Claims, 3 Drawing Sheets

HOT FORMING TOOLS FOR ALUMINUM AND MAGNESIUM SHEETS

TECHNICAL FIELD

This invention pertains to the preparation of steel tools for hot forming of certain light weight sheet metal alloys to reduce adherence of hot workpiece material to the tool surface. More specifically, this invention pertains to embedding low friction particles in a modified nitrocarburized tool steel forming surface for reducing friction between the forming surface and sheet metal workpiece and adherence of the workpiece material to the tool.

BACKGROUND OF THE INVENTION

There is a need to increase the use of light weight metal alloys in the manufacture of automotive vehicles. For example, aluminum alloy sheet workpieces are formed in elevated temperature forming processes into inner and or outer vehicle closure panels. And there is a desire to use magnesium alloys in like hot forming operations.

Certain aluminum alloys may be prepared in sheet form to display a high level of formability. Some such aluminum sheet alloys (e.g., AA5083) are heated to temperatures of the order of 450° C. and hot blow formed into and stretched against shaped forming surfaces of suitable tools to form vehicle tailgate panels, door panels and the like. While the hot aluminum material is quite formable, it tends to adhere to hot tool surfaces, requiring special tool alloys, special surface coatings for the tools, and frequent cleaning or repair of the forming surfaces. Any adhesion of an aluminum workpiece to its forming tools is of particular concern since sticking of workpiece material on the forming tool directly influences the final quality of each formed part.

Other aluminum alloys (AA5xxx and 6xxx) or magnesium alloys are heated to hot stamping/forming temperatures (e.g., about 300° C. and higher) and formed between suitable forming dies. Again, the hot aluminum sheet material tends to adhere to tool surfaces to the detriment of the formed parts and uninterrupted forming operations.

It is a purpose of this invention to provide sheet metal forming tools made of readily available hard tool steel compositions with surfaces displaying reduced friction and less adhesion when the tools engage and deform light metal alloy workpieces.

SUMMARY OF THE INVENTION

Forming tools (sometimes called "dies") for light weight metal alloy sheet materials are often massive metal bodies with precisely shaped forming surfaces. Often a set of two such tools is employed to deform a pre-heated sheet metal blank or workpiece into a body panel or other article of manufacture of complex three-dimensional shape. The tools are carried on opposing platens of an axially reciprocating press. The tools may be heated with, for example, internal electrical resistance heating elements so that their surfaces may be maintained at a predetermined temperature range for shaping of one or more metal sheets. In the hot blow forming of aluminum sheets, the die surfaces may be at a temperature of about 450° C. and in hot stamping of aluminum sheets, the die surfaces may be at about 300° C. or higher. Aluminum alloy workpieces may be preheated to like temperatures. With the press in its open position, a hot aluminum alloy blank sheet is placed between opposing tools, and the press is closed for plastic deformation of the sheet between and against one or both forming surfaces.

Such forming tools are often made from available blocks of tool steel compositions, such as P20 and H13 tool steel alloys. Tool steel alloys are known ferrous base alloys with varying amounts of, for example, carbon, chromium, manganese, molybdenum, silicon, vanadium, and the like, that are formulated and specified to provide suitable forming surface hardness and finish at elevated temperatures for the forming of aluminum and magnesium alloys. A block of such composition is used in making the forming tool, P20 steel blocks being available for this purpose. The tool making process may involve adapting the block for internal heating elements and temperature sensors, for application of insulation, and for attachment to a press platen. One or more surfaces of the steel tool will be carefully machined to provide forming surfaces for precise forming of sheet metal workpieces to close dimensional tolerances. The tool block may be annealed at a temperature above its intended operating temperature to stabilize the tool composition for accurate forming of a succession of hot workpieces.

In accordance with embodiments of the invention, forming tool surfaces of such alloys are treated to provide relatively low friction and low workpiece metal pickup when the tool is heated to elevated temperatures and engaged in forced sliding contact with aluminum or magnesium alloy workpieces, or the like.

The forming surface of the ferrous metal tool is suitably cleaned, if necessary, for surface modification by a nitrocarburization process. The tool is often large but it is the forming surface or surfaces that need to receive the nitrogen and carbon infusion. Accordingly, it may be preferred to place the tool in a suitable furnace for nitrocarburization by a gas atmosphere. In nitrocarburization, nitrogen and carbon atoms are thermally diffused simultaneously into the steel surface at a temperature near the eutectoid point (565° C.). A nitrocarburizing gas comprising ammonia and methane may be formulated for reaction with the forming surface of the tool. Nitrocarburization reactions in the range of about 555° C. to about 575° C. for about two to about four hours are suitable. Diffusion of nitrogen and carbon atoms into the iron lattice of the tool surface form a hard, wear and corrosion resistant "case" composed of a compound layer on the treated surface and an underlying diffusion zone. The nitrocarburization process may also be carried out by means other than a gaseous media such as, for example, a salt spray bath or a plasma treatment.

The composition of a compound layer produced under the above nitrocarburization conditions is found to comprise a major portion of $Fe_3N$ (epsilon phase, $\epsilon$) with $Fe_2O_3$ and $Fe_4N$ (gamma-prime phase, $\gamma'$) with $Fe_3O_4$. The compound layer is typically rich in the epsilon phase and may have a thickness of about five to about twenty-five micrometers. The underlying diffusion layer may extend one hundred micrometers or more below the compound layer on the surface of the tool.

Systematic analysis of the compound layer reveals that the ferric oxide and $Fe_4N$ ($\gamma'$) cover the $\epsilon$ phase. It is found that when the $\gamma'$ phase and ferric oxide are largely removed by grinding or polishing, $\epsilon$ phase is uncovered. And it is found that the $\epsilon$ phase is resistant to adhesion to aluminum alloy materials at temperatures used in high temperature sheet forming operations. In accordance with an embodiment of this invention, most, or all, of the thin $\gamma'$ and ferric oxide are removed from the nitrocarburized tool forming surface by mechanical polishing to expose underlying epsilon phase material in the compound layer. Such nitrocarburization and polishing are performed so as to retain acceptable shape and dimensions of the forming surface.

In the next step of the forming surface treatment, particles of a relatively low friction material, such as boron nitride (BN) or tungsten disulfide ($WS_2$) are implanted into the epsilon-phase compound layer material now at the forming surface of the tool. The particles may be blown at high pressure against the surface and embedded in the epsilon-phase rich compound layer. The surface is then heated to diffuse the low friction particles into the surface. The low friction material is selected to be engaged by a workpiece surface at a temperature of about 250° C. to about 500° C. without melting or decomposition.

The above described processing steps yield a forming surface for elevated temperature forming of aluminum alloys, magnesium alloys, and other metal compositions that tend to stick to a forming surface of a steel forming tool at elevated temperatures of, for example, about 250° C. to about 500° C. The forming surface of the ferrous metal tool is characterized by an iron lattice containing the inherent alloying elements of the steel composition. The forming surface-region iron lattice also contains carbon and nitrogen chemical species of a gas nitocarburization to a depth of about 25 micrometers of compound layer and about 200 micrometers or more of underlying diffusion layer. Gamma prime-phase material and oxide are largely removed from the upper surface of the as-formed nitrocarburization compound layer. The forming surface of the tool also comprises embedded particles of forming temperature resistant, low friction material in the epsilon phase material, generally coextensive with the forming surface without protruding above the forming surface. The resulting nitrocarburized, polished and low friction particle-containing tool surface is useful in low friction, non-adherent forming of many aluminum and magnesium sheet metal workpieces over extended periods of press operation before cleaning or refinishing of the tool surface becomes necessary.

Other objects and advantages of the invention will be apparent from a detailed description of certain preferred embossments which follows.

DESCRIPTION OF PREFERRED EMBODIMENTS

Hot blow forming, which includes processes such as quick plastic forming (QPF) and super plastic forming (SPF), generally represents a process in which a relatively thin sheet metal workpiece is forced into conformance with a forming surface of a forming tool by a pressurized gas. Suitable sheet metal workpieces utilized in such hot blow forming processes are generally only about a millimeter to a few millimeters in thickness and are composed of materials capable of undergoing high deformation (sometimes superplastic deformation) such as known aluminum and magnesium alloys. To facilitate such high deformation, the forming tool and the sheet metal workpiece are often times heated to elevated temperatures in order to attain the desired formability characteristics in the sheet metal workpiece. But these elevated temperatures as well as continuous, high-output manufacturing places high demands on the forming tools in terms of wear mechanisms such as adhesion between the sheet metal workpiece and the forming surface, mechanical interaction of surface asperities, plowing of one surface by asperities on the other surface, and deformation and/or fracture of surface layers such as oxides, to name but a few. And the extent of these and other known interactions between the forming surface of the forming tool and the contacting surface of the sheet metal workpiece can significantly influence the quality and aesthetic appearance of the finished and fully conformed sheet metal workpiece. Furthermore, localized sticking of the sheet metal workpiece to the forming surface can result in material build-up over time which in turn leads to galling on successively formed worked pieces unless regular maintenance is performed.

To help neutralize these concerns, at least the forming surface of the forming tool may be nitrocarburized and then provided with imbedded low-friction particles to improve its tribological performance when subjected to the somewhat rigorous conditions associated with hot blow forming. While the discussion so far has focused on hot blow forming, it is to be understood that these concepts are also practicable for procedures such as hot stamping or traditional stamping in which forming surface temperatures often exceed 300° C. and thus experience many of the same issues as hot blow forming.

Figure 1:
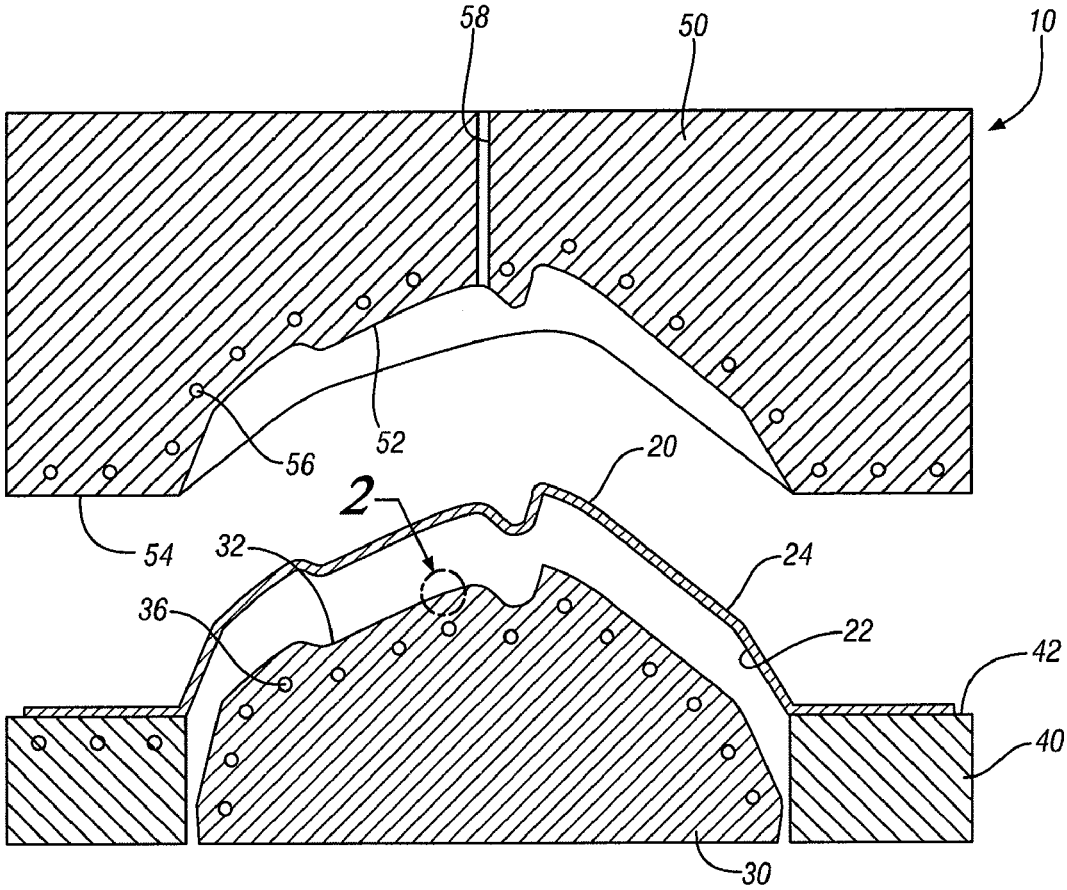
FIG. 1 is a side view in cross-section of a steel tool for use in hot blow (or stretch) forming of aluminum alloy sheet material.

As an illustrative example, FIG. 1 shows a two-stage hot blow forming assembly 10 for blow forming a thin sheet metal workpiece 20 into an automobile component such as a vehicle liftgate or decklid, and generally includes a lower tool 30, a binder ring tool 40, and an upper tool 50. Each of these tools 30, 40, 50 can be made of an appropriate tool steel alloy capable of providing a suitable forming surface hardness such as, but not limited to, heat-tempered AISI P20 and AISI H13 tool steel alloys. The sheet metal workpiece 20 may be comprised of any appropriate material but is represented here as a widely used aluminum alloy designated AA 5083, which has a typical composition, by weight, of 4-5 percent magnesium, 0.3-1 percent manganese, and lesser amounts of chromium, copper, and iron, with the balance aluminum. The sheet metal workpiece 20 generally includes a bottom surface 22 and a top surface 24 and is defined by a thickness of up to about four millimeters. And furthermore both the bottom surface 22 and the top surface 24 are customarily lubricated with, for example, a boron nitride-based lubricant.

Lower tool 30 includes a lower forming surface 32 that defines a slightly convex protuberance over and around which the bottom surface 22 of the sheet metal workpiece 20 is stretched and precisely deformed. Electrical resistance heating rods 36 embedded or otherwise positioned within the lower forming tool 30 provide a reliable and controllable mechanism for manipulating the temperature in thermal characteristics of the lower tool 30 during hot blow forming. The binder ring tool 40 surrounds the lower tool 30 and is independently vertically displaceable therefrom. An upward facing surface 42 of the binder ring tool 40 allows for air-tight engagement against a periphery of the bottom surface 22 of the sheet metal work piece 20 throughout the two-stage hot blow forming process, if desired. The upper tool 50 is similar in many respects to the lower tool 30 and includes an upper forming surface 52 shown here as defining a slightly concave cavity substantially complementary in shape and size to the lower forming surface 32. A downward facing peripheral edge or surface 54 facilitates an air-tight engagement against a periphery of the top surface 24 of the sheet metal workpiece 20. A plurality of electrical resistance heating rods 56 are carried by the upper tool 50 and operate in a similar manner as those shown in lower tool 30. The upper tool 50 is also provided with a working gas conduit 58 which supplies a working gas at a controlled pressure capable of stretching the bottom surface 22 of the sheet metal workpiece 20 into conformance with the lower forming surface 42.

In operation of the two-stage hot blow forming assembly 10, the sheet metal workpiece 20 is first preformed against the upper forming surface 52 of the upper forming tool 50. To start the sheet metal workpiece 20 is preheated and received as a flat or slightly preformed stock between the lower forming tool 30, the binder ring tool 40, and the upper forming tool 50. The tools 30, 40, 50 are appropriately separated or vertically spaced apart as shown in FIG. 1 (ignoring the deformed sheet metal workpiece for now) so as to easily accommodate the workpiece 20. Each of the tools 30, 40, 50 are also preheated to their predetermined heating temperature or temperature range, which may vary but is typically around 450° C. for this particular sheet metal workpiece 20.

The binder ring tool 40 is then raised so that sheet metal workpiece 20 is clamped around its periphery between the peripheral edge or surface 54 of the upper forming tool 50 and the upper surface 42 of the binder ring tool 40. The lower forming tool 30 is also raised simultaneously with or shortly after the binder ring tool 40 is raised and facilitates the deformation of sheet metal workpiece 20 into a preformed article somewhat resembling its final shape but not quite as complex or precise. For instance, the lower forming tool 30 may be utilized as a punch in which it engages the bottom surface 22 of the sheet metal workpiece 20 and presses the workpiece 20 upwardly against the upper forming surface 52 before retreating; or it may be positioned close to but not in contact with the bottom surface 22 of the sheet metal workpiece 20 so that gas pressure can be applied to the bottom surface 22 in order to stretch the sheet metal workpiece 20 upwardly and against the upper forming surface 52. This performing of sheet metal workpiece 20 produces rather large curves with large radii and is intended to complete a substantial portion of the total required deformation while leaving the more complex and sharper contours to be subsequently completed in a second forming stage.

In the second forming stage, with the sheet metal workpiece 20 still being clamped between the upper forming tool 50 and the binder ring tool 40 as in the preforming stage, the lower forming tool 30 is positioned just below and very near the bottom surface 22 of the sheet metal workpiece 20. Pressurized gas is then introduced against the top surface 24 of the sheet metal workpiece 20 via the working gas conduit 58 in the upper forming tool 50. As a result the bottom surface 22 of the sheet metal workpiece 20 is stretched at anticipated strain rates into tight conformance with the lower forming surface 32 of the lower forming tool 30 to provide the remaining and more intricate deformations required in the ultimate end-product. The pressure of the gas may be gradually increased according to QPF practices, or it may be controlled in other known alternative fashions.

During the course of facilitating many successive sheet metal workpiece 20 deformations at high temperatures (on a magnitude of tens of thousands per year), the lower forming surface 32 and the bottom surface of the sheet metal workpiece 20 may begin to experience the adverse interactions described earlier. And these interactions can negatively impact manufacturing output and the quality of the final product. It may therefore be beneficial to treat at least the lower forming surface 32 in accordance with the following practices to help ensure a more efficient and longer-running blow forming process capable of handling a high quantity of sheet metal workpiece 20 deformations. The treatment of the lower forming surface 32 may be performed during the manufacturing of the lower forming tool 30 prior to initial installation in the hot blow forming process line. Or on the other hand it may be performed while refurbishing an old lower forming tool 30 that has been taken out of production for routine cleaning or other necessary maintenance. Of course the other contacting surfaces of the hot blow forming assembly—namely surfaces 42, 52, and 54—may also be similarly treated if desired as they experience many of the same types of surface interactions and potential process pitfalls as the lower forming surface 32.

As will now be described with reference to FIGS. 2-5, the heated lower forming surface 32 may be treated to, among others, reduce the occurrence of adhesion and material transfer between itself and the sliding and intimately engaged bottom surface 22 of sheet metal workpiece 20. Such a treatment generally includes, but is not limited to, nitrocarburizing at least the lower forming surface 32 of the forming tool 30, and implanting particles of relatively low-friction material into the as-nitrocarburized lower forming surface 32. For illustrative purposes only this treatment will be demonstrated in detail as it pertains to a lower forming tool constructed of AISI P20 steel alloy. This steel alloy has a typical composition of about 0.35% carbon, about 0.70% silicon, about 0.83% manganese, about 1.90% chromium, about 0.40% nickel, about 0.49% molybdenum, about 0.02% phosphorus, and the balance iron.

Before nitrocarburization can be practiced, however, it may be beneficial to clean the lower forming surface 32. This helps ensure that the lower forming surface 32 is free from any substances that may unnecessarily impede the nitrocarburization process. For example, new forming tools are often rather contaminated when first received due to transportation, handling, and storage practices. Other substances that may also be initially present include particulate matter such as machining chips, and fluid residues from those of machining fluids and lapping compounds. The lower forming surface 32 may be cleaned of these and other commonly encountered substances before nitrocarburization in accordance with common cleaning practices known to skilled artisans. Here, to cite but one example, the lower forming surface 32 was cleaned with alcohol then washed in an alkaline solution for 45 minutes. Next, the lower forming surface 32 was rinsed with water and dried. And finally, the lower forming surface 32 was ground with 600 mesh emory paper and then polished with a 1 μm diamond paste.

The lower forming surface 32 may now be nitrocarburized in a commercial furnace or gas chamber appropriately sized to accommodate the lower forming tool 30. The term "nitrocarburize" and variations thereof generally represent a thermally activated chemical process in which nitrogen and carbon atoms are diffused simultaneously into the iron lattice of the lower forming surface 32 of the lower forming tool 30 near the temperature of the eutectoid point (about 565° C.) of the Fe—C—N phase diagram. This simultaneous diffusion of nitrogen and carbon atoms 30 forms a "case" that extends downwardly from the lower forming surface 32 into the forming tool 30. As illustrated schematically in FIGS. 2-4, the "case" is further composed of a shallow compound surface layer 60 and a deeper underlying diffusion layer 66. And as a general matter the thickness of both these layers 60, 66 tend to increase with higher nitrocarburization temperatures and longer treatment times. The portion of the lower forming tool 30 underneath the "case" and unaffected by the nitrocarburization, which is generally represented here as numeral 70, continues to exhibit the expected characteristics associated with the P20 tool steel alloy. In addition to the gaseous atmosphere, the nitrocarburization processes may also be carried out in a plasma or salt bath medium.

In general, the compound layer 60 is largely composed of carbonitrides that provide the layer 60 with corrosion and wear resistant properties. It is also significantly harder than the underlying diffusion layer 66 and the even further underlying and unaffected P20 steel alloy 70. More specifically the compound layer 60 assumes a somewhat controllable mix of $Fe_3(N—C)$ [hereafter epsilon phase (ϵ)] and $Fe_4(N—C)$ [here after gamma-prime phase (γ')] carbonitrides based on process parameters such as temperature, heat treatment time, and gas composition and pressure. It is also not uncommon for the compound layer to appear as multiple distinct and adjacent sublayers each dominated by one of these carbonitride crystal structures. The depth or thickness of the compound layer 60 may be varied but is typically between about 5 μm and about 40 μm.

The diffusion layer 66 generally defines the approximate depth underneath the compound layer 60 to which nitrogen and carbon diffuse into the lower forming tool 30. This layer is significantly less concentrated in ϵ-phase and γ'-phase carbonitrides than the compound layer 60 largely due to the inhibiting role of the thick and clustered carbonitrides that originally form as the compound layer 60. But nevertheless it is still harder than the unaffected P20 tool steel 70 and thus provides some fatigue resistance to abusive loading of the lower forming tool 30. The diffusion layer 66 also supplies a gradient between the compound layer 60 and the underlying and unaffected P20 tool steel 70 for handling the near-surface compressive strains often experienced in hot-blow forming. The depth or thickness of the diffusion layer 66 may also vary but is typically between about 100 μm and about 400 μm.

It has been found through experimentation that a predominantly epsilon-phase compound layer 60 exhibits the lowest tendency towards aluminum adhesion and material transfer and thus contributes to improved galling resistance. And in furtherance of this observation a suitable set of nitrocarburization process conditions includes subjecting the lower forming surface 32 in a nominal atmosphere of 50% $NH_3$ and 50% $CH_4$ at about 560° C. for a period of about four hours. But of course these conditions can be varied to some extent without compromising the principle purpose of the nitrocarburization process. A brief discussion addressing how these process conditions were obtained can be found below.

Figure 2:
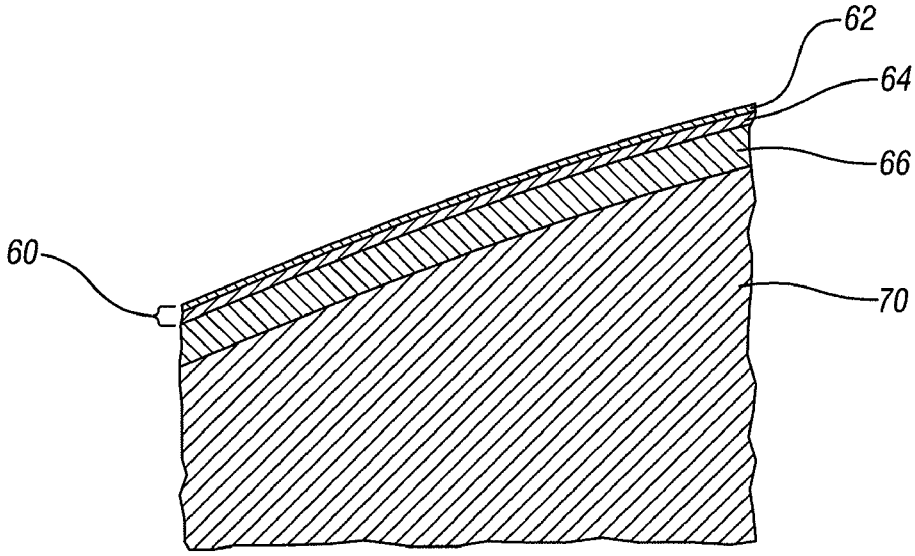
FIG. 2 is an enlarged schematic drawing of a small cross-section of the forming surface of the tool (at region 2 of FIG. 1) showing a complex compound surface layer and underlying diffusion layer following gas nitrocarburization of the forming surface. The compound layer has an outer layer of predominately gamma-prime ($Fe_4N$) and $Fe_3O_4$, and a lower layer of epsilon phase $Fe_3N$.

As schematically illustrated in FIG. 2, these process conditions for the most part generate a compound layer 60 comprised of a ϵ-phase rich layer 64 measuring approximately 25 to 30 μm in thickness, and an overlying γ'-phase and ferric oxide ($Fe_3O_4$) layer 62 of much lesser thickness. The diffusion layer 66 extends approximately another 300 μm or so into the lower forming tool 30. It should be noted, however, that the ϵ-phase rich layer 64 and the γ'-phase/ferric oxide layer 62 are not necessarily layers of uniform thickness with smooth identifiable boundaries as illustrated in FIG. 2. Rather, a more accurate depiction of these layers can be seen in the image produced by an Electron Probe Microanalyzer and shown as FIG. 5. There, the different layers produced by the nitrocarburization process were identified based on the concentration of diffused nitrogen. And as a rough estimate, all or most of the γ'-phase and ferric oxide layer is bound by the two vertical dashed lines inserted into the image, while the ϵ-phase rich layer is considered to be present primarily to the right of the longer (right-most) vertical dashed line. But in the interest of clarity reference will continue to be made to schematic and idealized illustrations of FIGS. 2-4.

Figure 3:
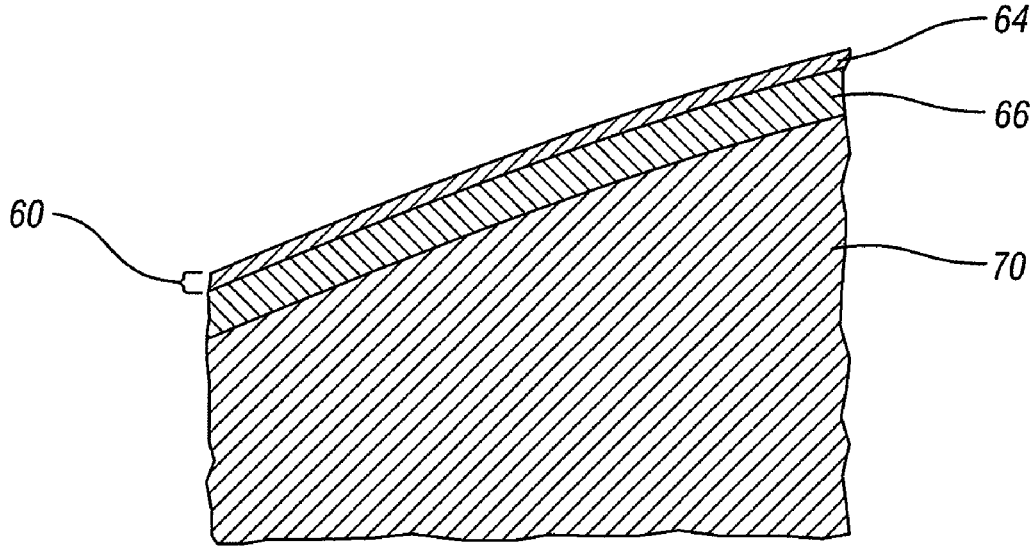
FIG. 3 is an enlarged schematic drawing of a small cross-section of the forming surface of the tool (at region 2 of FIG. 1), as in FIG. 2, showing the exposed epsilon phase material after removal of the gamma-prime and oxide material.

Next, as illustrated in FIG. 3, all or at least a significant portion of the γ'-phase/ferric oxide layer 62 may be removed to expose the ϵ-phase rich layer 64 while maintaining the precise contour of the lower forming surface 32. This can be done in several ways. Here, the compound layer 60 was mechanically polished with a 1 μm diamond paste to remove approximately the top 5 μm of the compound layer 60. Or as an alternative, the γ'-phase/ferric oxide layer 62 may be naturally worn off by completing a dozen or so hot blow forming procedures against the lower forming surface 32. The compound layer 60 is now essentially composed of only the ϵ-phase rich layer 64.

Figure 4:
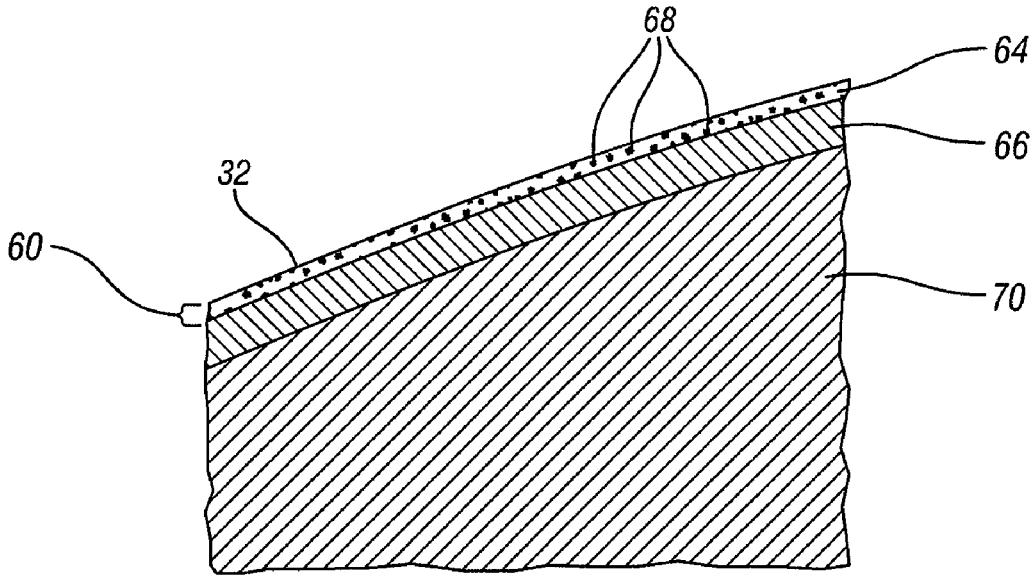
FIG. 4 is an enlarged schematic drawing of a small cross-section of the forming surface of the tool (at region 2 of FIG. 1) after low friction particles have been embedded in residual epsilon phase material of the compound layer.
Figure 5:
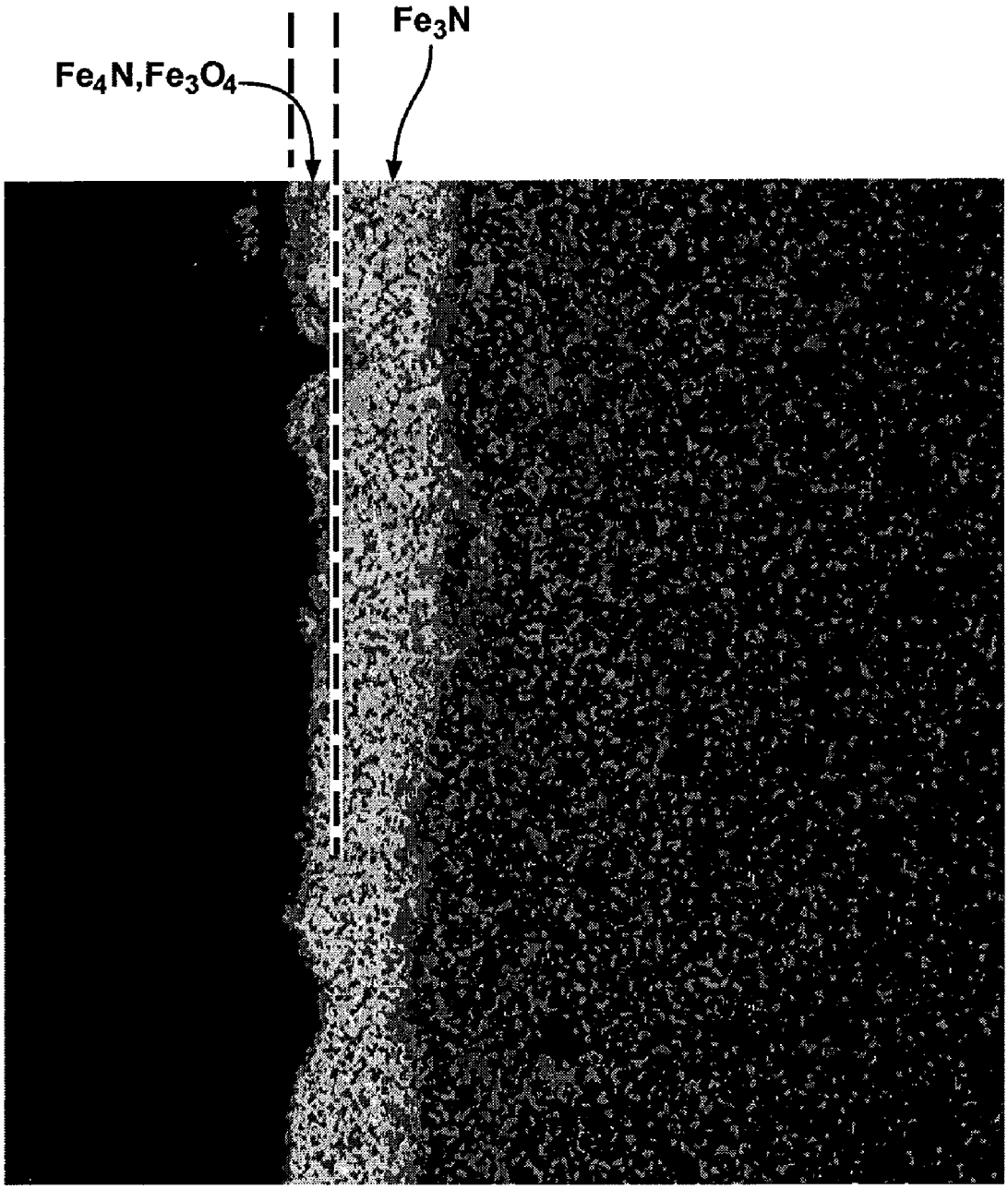
FIG. 5 is an image produced by an Electron Probe Microanalyzer of the compound layer and the underlying diffusion layer schematically illustrated in FIG. 2.

The relatively low friction lubricant particles 68, such as those of boron nitride (BN) or tungsten disulfide ($WS_2$), may now be implanted into the ϵ-phase rich compound layer 60 as illustrated in FIG. 4. This can be achieved by mechanically impacting the lubricant particles 68 against the as-nitrocarburized lower forming surface 32 at high velocity, and then diffusion bonding the particles 68 into the compound layer 60. The lubricant particles 68 may be impacted at high velocity against the lower forming surface 32 by way of a suitable shot-peening procedure. But first the lubricant particles 68 may need to be prepared and loaded onto appropriate shot media. This generally involves refining the lubricant to an appropriate grain size and then mixing it with the shot media so as to ensure to the greatest extent feasible that the shot media is adequately and uniformly coated. Skilled artisans will know how to accomplish this feat and the types of blenders and mixing apparatuses that may be utilized. But to cite one specific example, clean stainless steel shots generally spherical in shape with a diameter of about 0.20 mm were mixed with dry lubricant particles 68 having a grain size that ranged from about 5 μm to about 0.10 mm in a tumble-type blender.

The loaded shot media may then be launched by a carrier gas through one or more nozzles at high-velocity against the as-nitrocarburized lower forming surface 32. The kinetic energy generated by the mechanical impact thrusts the lubricant particles 68 against the lower forming surface 32 creating a metallurgical bond between the particles 68 and the surface 32 while the shot media is deflected away. As a result the lower forming surface 32 now comprises a surface compound layer 60 rich in the ϵ-phase carbonitride crystal structure that has an appreciable amount of relatively low friction lubricant particles 68 mechanically fused to its surface. Any non-bonded lubricant particles 68 residually present on the lower forming surface 32 may be easily removed with compressed air. Of course, care should be taken at all times during the shot-peening procedure to preserve the precise and uniquely machined contours of the lower forming surface 32. With this in mind as well as the understanding that shot-peening processes are subject to considerable variation, a typical set-up may place the one or more nozzles substantially perpendicular and about 0.5 inches to about 4 inches from the lower forming surface 32. The carrier gas, which may be ambient air, may be pressurized in the range of about 80 to about 120 psi to ensure the shot media impact the lower forming surface 32 at high-velocity.

The lower forming surface 32 may now be heated to diffusion bond the lubricant particles 68 deeper into the compound layer 60. This heating may be carried out in a non-reactive atmosphere at a temperature between about 2% and about 50%, and usually between about 20% and about 40%, of the melting temperature of the P20 steel tool alloy from which the lower forming tool 30 is constructed. The thermal energy supplied here in conjunction with the energy stored in the metallurgical bonds facilitates migration of the low friction particles 68 into and away from the surface of the compound layer 60. Under these circumstances the low friction particles 68 can typically penetrate the compound layer 60 to a depth of about 2 μm to about 5 μm, thus becoming an integral part of the compound layer as opposed to being loosely held particles attached to its surface. The heating periods often required to achieve this type of diffusion often range from about 2 hours to about 5 hours, but heating durations as brief as about 1 minute to as long as about 100 hours are conceivable.

The lower forming surface 32 of the lower forming tool now has a "case" that comprises, in addition to the diffusion layer 66, a surface compound layer 60 dominated by the ϵ-phase rich layer 64, and an appreciable amount of relatively low friction lubricant particles 68 dispersed within the compound layer 60. And the fact that the "case" and the low friction lubricant particles 68 are diffused into the lower forming surface 32 may be helpful beyond the improved sticking and galling resistance. For instance, the surface geometry of the lower forming surface 32 is not significantly distorted by either the nitrocarburization or the implantation of the low friction lubricant particles 68 as is often the case when bulky lubricious coatings are applied. Instead, the microstructure of the very top portion of the lower forming surface 32 is altered to improve its workability during hot blow forming. This eliminates the redundant and tedious reconfiguration of the surface tool geometry (surface buy-off) that is often performed when lubricious coatings are utilized. And further the potential elimination of lubricious coatings alleviates any concerns that differential thermal expansion will cause the coatings to delaminate and thus stop or slow production. While the discussion up to this point has focused on the lower forming surface 32 of the lower forming tool 30, it should be understood that any surface that experiences contact with the sheet metal workpiece 20 may be similarly treated to achieve similar results. Other notable surfaces described here include the upper forming surface 52 and the downward facing peripheral edge or surface 54 of the upper forming tool 50, and the upward facing surface 42 of the binder ring tool 40.

Returning now to the nitrocarburization process, a systematic investigation of three different and plausible nitrocarburizing temperature/time regimes was conducted to determine the nitrocarburizing process conditions previously specified. Each nitrocarburization procedure consisted of three steps. First, a heat-tempered (at about 600° C.) specimen of AISI P20 tool steel alloy was cleaned as previously described. Second, the specimen was preheated to about 300° C. and loaded into a furnace that maintained a nominal atmosphere of about 50% $NH_3$ and about 50% $CH_4$. And third, the specimen was nitrocarburized at its respective temperature/time regime and then slow cooled to room temperature. The following table lists the three temperature/time regimes studied.

Nitrocarburization Conditions

| Regime | Time (hours) | Temperature ° C. |
|---|---|---|
| A | 2 | 510-524 |
| B | 2 | 560-571 |
| C | 1 | 610-621 |

The temperatures in regimes A and B were purposefully kept under 571° C. so as to remain below the eutecoid point (about 591° C.) of the Fe—N phase diagram. They both also lie below the temperature at which P20 tool steel alloy is tempered (about 600° C.) after final machining in order to relieve stress. Conversely, regime C was carried out above both the eutecoid point and the temperature at which tempering is performed.

Following nitrocarburization the microstructure of each specimen was analyzed. It was observed that in general the higher temperature regimes lead to thicker compound and diffusion layers. The compound layer in regimes A, B, and C was measured at 6 μm, 15 μm, and 20 μm respectively. And the diffusion layer in regimes A, B, and C was measured at 160 μm, 250 μm, and 300 μm respectively. It was also observed that the higher temperature regimes produced deeper diffusions of greater amounts of nitrogen while not affecting the diffusion of carbon all that much. The microhardness of each specimen was also examined. The compound layer in regimes A and B were found to be the hardest at roughly 1200 HK. The compound layer in regime C was determined to be about 1160 HK. In each specimen the diffusion layer was less hard than its respective compound layer but still harder than the underlying and unaffected P20 tool steel alloy.

Next, the surfaces of the as-nitrocarburized specimens were ground off layer-by-layer to expose the compound and diffusion layers. A beam X-ray diffraction analysis was conducted after the removal of each layer. In regimes A and B it was found that the ϵ-phase carbonitride crystal structure was the dominant phase, while γ'-phase carbonitride crystal structure was the dominant phase in regime C. Regime B was therefore selected for further investigation because it had the thickest compound layer dominated by the ϵ-phase carbonitride. As such, the nitrocarburization treatment time was doubled from 2 hours to 4 hours for regime B. The increased treatment time produced a predominantly ϵ-phase carbonitride layer about 30 μm in thickness covered by a substantially thinner layer composed of the γ'-phase carbonitride and ferric oxide. Thus regime B and the increased treatment time were deemed suitable for the nitrocarburization procedure of the hot blow forming tool.

As described above, following nitrocarburization much or all of the γ'-phase carbonitride and oxide are polished or worn from the surface so that the low friction particles are embedded predominately in epsilon phase material.

Practices of the invention have illustrated in the description of preferred embodiments. But the scope of the invention is not limited to these illustrations.

The invention claimed is:

1. A ferrous metal tool for forming aluminum alloy or other light metal alloy sheet workpieces at forming tool and workpiece temperatures above about 250° C., the tool having a body with a machined portion defining a forming surface for sliding contact engagement with a heated sheet workpiece in deforming the workpiece, the forming surface comprising:

a nitrocarburized surface layer at a forming surface to be contacted by the workpiece, the nitrocarburized surface layer being coextensive with the forming surface, the nitrocarburized surface layer initially comprising a compound surface layer with an underlying diffusion layer, the compound surface layer comprising an outer gamma-prime phase and underlying epsilon-phase; and the nitrocarburized epsilon phase material of the compound layer containing embedded particles of low friction material that are infusible at the forming temperature of the forming surface, and at least a majority of the gamma-prime phase layer being removed from the forming surface of the tool prior to embedding of the particles in the epsilon phase material.

2. A forming tool as recited in claim 1 in which the tool is formed of P20 tool steel.

3. A forming tool as recited in claim 1 in which the depth of the nitrocarburized compound layer before the gamma-prime phase is removed from the surface of the tool is in the range of about five micrometers to about fifteen micrometers.

4. A forming tool as recited in claim 1 in which the depth of the nitrocarburized diffusion layer after removal of the compound layer is greater than about fifty micrometers.

5. A forming tool as recited in claim 1 in which the low friction particles comprise at least one of boron nitride and tungsten sulfide.

6. A method of making a forming tool for the forming of aluminum alloy sheet metal workpieces, or sheet metal workpieces of other light metal alloys, at a forming temperature of at least 250° C., the method comprising:

machining a surface on a ferrous metal tool body, the surface being shaped for sliding contact engagement with a sheet metal workpiece to deform a contoured shape in the sheet metal at the forming temperature;

cleaning the machined surface for nitrocarburization;

nitrocarburizing the machined surface to form an outer compound layer and an underlying diffusion layer generally coextensive with the intended forming surface, the compound layer comprising an outer gamma-prime phase material and an underlying epsilon phase material;

removing gamma-prime phase material from the compound layer to expose epsilon phase material; and embedding low friction particles in the epsilon phase material and coextensive therewith to yield a forming surface on the tool body, the friction particles being substantially non-fusible in the epsilon phase layer at the forming temperature of the tool for the sheet metal workpieces, the forming surface for the sheet metal workpieces thus comprising the low friction particles embedded in the nitrocarburized forming surface.

7. A method of making a forming tool as recited in claim 6 when the machined surface is gas nitrocarburized.

8. A method of making a forming tool as recited in claim 6 when the machined surface is gas nitrocarburized at a temperature in the range of about 555° C. to about 575° C.

9. A method of making a forming tool as recited in claim 6 in which the as-formed nitrocarburization compound layer is about five to fifteen micrometers in thickness.

10. A method of making a forming tool as recited in claim 6 in which the nitrocarburization diffusion layer is formed to a depth of greater than about fifty micrometers in the forming surface.

11. A method of making a forming tool as recited in claim 6 in which the nitrocarburization compound layer is about five to fifteen micrometers in thickness and the gamma-prime phase is removed by mechanical polishing.

12. A method of making a forming tool as recited in claim 6 in which low friction particles are embedded in the forming surface by blowing the particles at high velocity against the surface to cause them to stick to the surface and then heating the surface and particles to promote diffusion of the particles into the surface.

13. A method of making a forming tool as recited in claim 6 in which the low friction particles comprise boron nitride.

14. A method of making a forming tool as recited in claim 6 in which the low friction particles comprise tungsten disulfide.

* * * * *